United States Patent [19]

Gridley et al.

[11] Patent Number: 4,900,265

[45] Date of Patent: Feb. 13, 1990

[54] ARRANGEMENT FOR ORDERLY GUIDANCE OF CABLE ENDS

[75] Inventors: Michael Gridley; Hans-Ulrich Kalweit, both of Germantown, Md.

[73] Assignee: ANT Nachrichtentechnik GmbH, Backnang, Fed. Rep. of Germany

[21] Appl. No.: 287,256

[22] Filed: Dec. 21, 1988

[51] Int. Cl.[4] ..... H01R 4/66

[52] U.S. Cl. ..... 439/449

[58] Field of Search ..... 439/449, 460, 470, 474

[56] References Cited

U.S. PATENT DOCUMENTS

| | | | |
|---|---|---|---|
| 3,861,015 | 1/1975 | Hooven . | |
| 4,223,178 | 9/1980 | Lass | 439/449 |
| 4,679,123 | 7/1987 | Young . | |
| 4,737,117 | 4/1988 | Lockard | 439/449 |

FOREIGN PATENT DOCUMENTS

| | | |
|---|---|---|
| 0027696 | 4/1981 | European Pat. Off. . |
| 0174050 | 3/1986 | European Pat. Off. . |
| 2228780 | 1/1974 | Fed. Rep. of Germany . |

*Primary Examiner*—Joseph H. McGlynn

*Attorney, Agent, or Firm*—Spencer & Frank

[57] ABSTRACT

Comb-like cable guide elements are provided for each row or pair of rows of cable ends disposed at a distance from a plug-in contact plate for the orderly guidance of the cable ends to plug-in contacts of a plug-in contact plate. Free spaces are provided between adjacent cable guide elements for insertion of circuit boards toward contact strips disposed on the plug-in contact plate. To absorb the pull on the cable ends, resilient clamping devices are provided in the region of recesses in the cable guide elements.

14 Claims, 4 Drawing Sheets

ARRANGEMENT FOR ORDERLY GUIDANCE OF CABLE ENDS

BACKGROUND OF THE INVENTION

The invention is based on an arrangement for the orderly guidance of cable ends to plug-in contacts in a plug-in contact plate, with pull relief being provided for the cable ends.

If a plurality of cable ends are to be brought to a plug-in contact plate, it is necessary to guide the cable ends in an orderly manner.

European Pat. No. 174 050 A2 discloses a method and an apparatus for arranging and aligning flexible insulated conductors of an unaligned bundle of electrical conductors. The unaligned conductors are there pulled from an aligned location to between the flush teeth of two combs. The conductors are then pressed in a clamping manner into constrictions between the teeth of one comb.

U.S. Pat. No. 3,861,015 discloses clips for holding cable wires. These clips are composed of spring tongues by means of which the cable wires can be fixed relative to a base plate. To hold bundles of wires, plugs may be pushed through the base plate so as to accommodate the wire bundles between them.

U.S. Pat. No. 4,679,123 discusses a system for arranging cables in an orderly manner. Each cable bundle is brought to one of a plurality of superposed arrays. Plug-in strips are arranged on these arrays. One cable of each bundle leads to a plug-in strip of the associated array. At the interior wall of the cable rack frame, a U-shaped clip is provided for each cable bundle to surround this cable bundle and fix it to the frame. To prevent the individual cable bundles from interfering with one another, the U-shaped clips are arranged in steps on the inner wall of the rack frame.

DE-OS 2,228,780 discloses a pull relief arrangement for cables supplied to a plug-in strip. There a frame-like cable receiving device is provided in the form of a clamping member. The frame is provided with a slot through which cables or individual conductors can be brought in an orderly manner to the plug-in contacts of one row. Pull relief is realized by clamping in the cables or individual conductors. According to DE-OS 2,228,780, instead of a frame, a cable receiving device in the form of a rod fixed relative to the plug-in strip may also be employed. The free end of this rod is provided with a strap which can be formed into a loop. Through this loop, the cable ends are brought next to one another to the plug-in contacts. The pull on the cable ends is relieved by drawing the loop together, thus causing the cable ends to be gripped firmly.

European Pat. No. 27,696 A1 discloses the orderly guidance of shielded cable ends in the direction of a clamping strip. Chambers are provided for this purpose which are equipped with slotted cable holders on the cable input side. The individual conductors of the cables are inserted into these slots and are pull relieved by means of elastic plugs which are inserted into the slots above the individual conductors.

SUMMARY OF THE INVENTION

It is an object of the invention to configure an arrangement for the orderly guidance of cable ends to plug-in contacts in a plug-in contact plate, with pull relief being provided for the cable ends so that it is possible to provide orderly cable guidance to the mating sockets disposed on a plug-in contact plate, particularly for coaxial cables equipped with plug-in connectors. Additionally, the cable guidance should be configured in such a way that circuit boards can be inserted without interference from cables at least between some adjacent cable rows. Furthermore, it should be possible to pull-relieve the coaxial cable ends in such a way that the plug-in connectors when plugged into the mating contact plate are stressed as little as possible. Moreover, it should be possible to guide the circuit boards to be inserted between adjacent cable rows. This is accomplished by the features of claim 1. The dependent claims define advantageous modifications of the arrangement.

The arrangement according to the invention has the advantage that it can be expanded in a modular manner—if necessary, further cable guide elements can be retrofitted—and is easily modified. Due to the provision of space between the cable guide elements, circuit boards can be additionally inserted at any desired location or can be exchanged for new ones. This is necessary, in particular, if modules on the front of the plug-in contact plate are exchanged since in that case shunt boards, for example of the 225-pole type, must be inserted into the contact strips disposed on the rear of the plate.

BRIEF DESCRIPTION OF THE DRAWINGS

Embodiments of the invention will now be described in greater detail with reference to the drawing figures. It is shown in:

FIG. 6, a perspective overall view of the arrangement according to the invention.

DETAILED DESCRIPTION OF THE PREFERRED EMBODIMENTS

Figure 1:
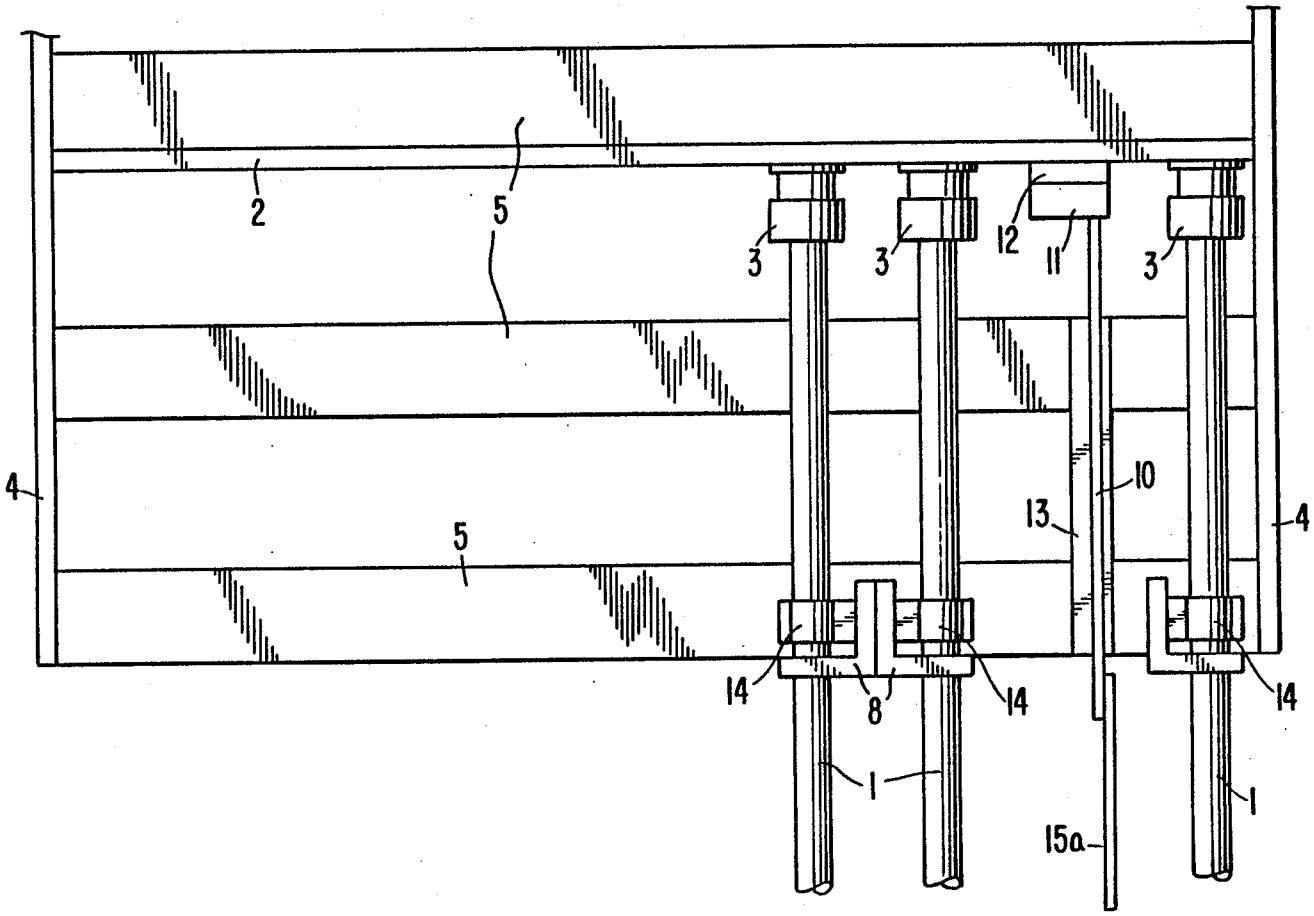
FIG. 1, a top view of the arrangement according to the invention.
Figure 2:
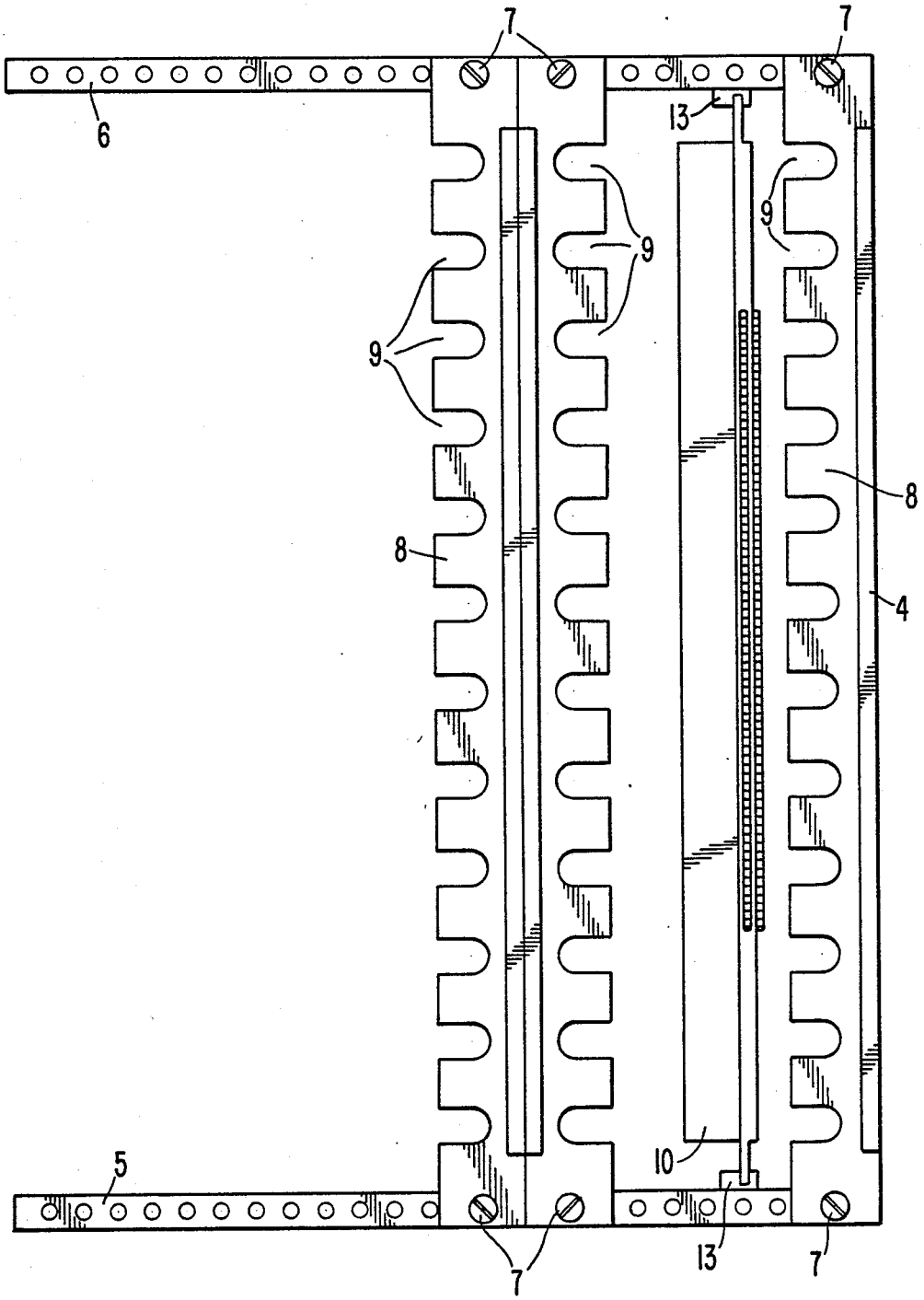
FIG. 2, a rear view of the arrangement according to the invention.
Figure 4:
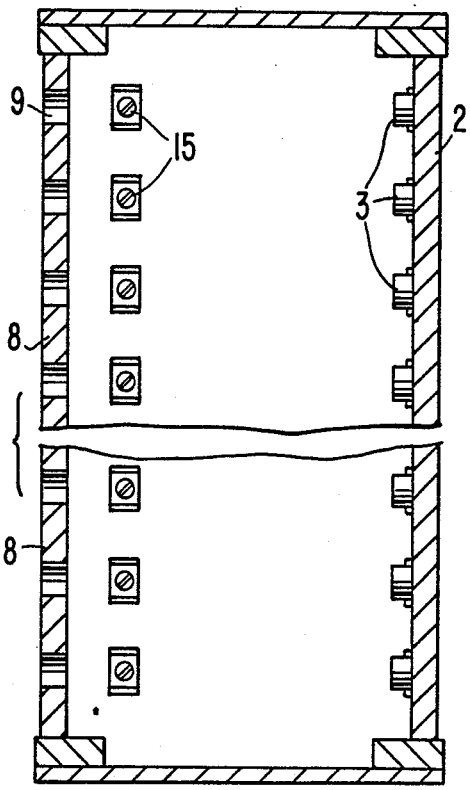
FIG. 4, a sectional view of the arrangement according to the invention in the region of the cable guide elements.

The top view of FIG. 1 shows the guidance of cable ends 1—here coaxial cable ends—to a plug-in contact plate 2. The plug-in connections between coaxial cable ends 1 and plug-in contact plate 2 is here effected by way of BNC connectors 3 on the rear of plug-in contact plate 2. Plug-in contact plate 2 is disposed on the frontal face of a framelike module carrier of which FIG. 1 shows the two side walls 4 and the lower connecting rails 5 of the module carrier frame. Plug-in contact plate 2 is fastened to the module carrier frame, for example, at the profiled arms of connecting rails 5 or by means of flanges. At a distance of, for example, 5 inches from plug-in contact plate 2, comb-like cable guide elements 8 are arranged in vertical juxtaposition in a plane parallel to the plug-in contact plate. As can be seen in FIG. 2, cable guide elements 8 form the rear plates of the module carrier. They are each composed of L-shaped profiled members whose ends are flat (FIGS. 1 and 2) so that they are able to rest on the lower rear rail 5 and on the upper rear rail 6 and can be screwed to these rails by means of screws 7. Thus, plug-in contact plate 2 is fixed relative to cable guide elements 8 by way of module carrier frame 4, 5, 6 which serves as the fastening means. As can be seen particularly well in FIG. 2, in their plane parallel to plug-in contact plate 2, cable guide elements 8 are provided with frontal recesses 9 which impart a comb-like appearance to cable guide elements 8 when viewed from the rear. Recesses 9 are slot shaped and are semi-circular at the bottom of the slot. The width of the slot and the semi-circular slot bottom are dimensioned in such a manner that one coaxial cable can just be brought through each slot. One vertical row of coaxial cable ends can be brought through each superposed arrangement of slots in one cable guide element 8. As further shown in FIGS. 1 and 2, cable guide elements 8 may be arranged in parallel next to one another in an individually spaced arrangement or in parallel spaced pairs next to one another. This results in a matrix-like organization principle. In the arrangement in pairs, the arms of the L-shaped profiled members not provided with recesses lie closely next to one another and are advisably screwed together. The distance between individual cable guide elements 8 or the pairs of juxtaposed cable guide elements is dimensioned in such a way that, without interference by the cable ends, circuit boards 10, for example in the form of shunt boards, can be inserted in the direction toward plug-in contact plate 2 into the free spaces between every pair of cable guide elements 8 whose slots face one another. Shunt boards 10 are provided on their one frontal face with a 225-pole contact strip 11 which, after insertion into a corresponding contact strip 12, engages in plug-in contact plate 2. In order to provide good accessibility and manipulatability, the other frontal faces of shunt boards 10 is provided with handles 15 which project beyond the plane of the rear plate in the direction toward the operating personnel (FIG. 4). Contact strip 12 or a plurality of such contact strips, if several shunt boards 10 are provided, are always disposed between one or a plurality of perpendicular rows of plug-in contacts 3. To avoid errors in operation or damage to the 225-pole plug-in connectors—for example due to tilting of the shunt boards—the under and upper sides of the shunt boards are guided in groove-like rails 13. These rails 13 may be fastened to rails 5 and 6 of the module carrier frame.

Figure 3:
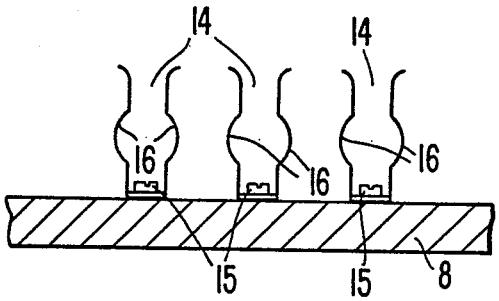
FIG. 3, a view of the resilient clamping devices.

In the region of recesses 9 of cable guide elements 8, resilient clamping devices 14 are provided. For each cable to be clamped in, these resilient clamping devices are composed of pairs of spring clips made of a flat material (FIG. 3). The spring clips are applied by means of screws 15 to those arms of the comb-like cable guide elements 8 in the form of L-shaped profiled members which are not provided with recesses, i.e. to those arms which are oriented perpendicularly to plug-in contact plate 2 (FIGS. 1 and 4). As shown in the sectional view of FIG. 4, the spring clips are applied so as to be flush behind recesses 9. Thus, after being inserted into recesses 9 of the cable guide elements, being clamped into the resilient clamping devices 14 and insertion of BNC connectors 3 into plug-in contact plate 2, the coaxial cable ends pass through the module carrier without changing their direction The spring clips are provided with sector-shaped bulges 16 approximately in the center of each spring clip for gripping around the coaxial cable sheath (FIG. 3). For easier insertion of the cables, the free ends of the spring clips are bent outwardly to form insertion funnels (FIG. 3).

Figure 5:
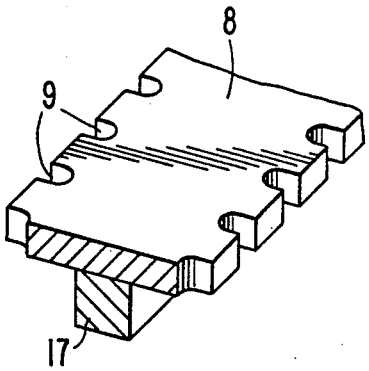
FIG. 5, an alternative configuration of the cable guide elements.

One alternative for the configuration of cable guide elements 8 is shown in FIG. 5. Now, cable guide elements 8 are no longer provided in the form of L-shaped profiled members, but have a plate-like configuration. Moreover, in contrast to the embodiment of FIG. 1, they are designed for two rows of recesses 9, namely for two adjacent rows whose recesses are provided with oppositely oriented opening directions. In this embodiment, connecting webs 17 provided between the underside and the upper side of the frame, onto which the centers of cable guide elements 8 can be placed, here serve as carriers for the resilient clamping device and for the plate-like cable guide elements 8. As before, cable guide elements 8 can be screwed directly to rails 5 and 6 or to connecting webs 17.

FIG. 6 is a perspective overall view of the arrangement according to the invention. The module carrier frame together with the plug-in contact plate is fastened at operating height between two vertically arranged carrier plates 18. A viewing opening 19 is visible in the lateral region of the frame. Below cable guide elements 8, there is provided a cable chute which serves to accommodate and direct away the cable bundles of a row of coaxial cables. In FIG. 6, only one row of cable guide elements is equipped with coaxial cables. And only one shunt board is inserted whose handle 15 projects beyond the plane of cable guide elements 8 which form the rear wall of the module carrier.

We claim:

1. In a device for the orderly guidance of cable ends to plug-in contacts in a plug-in contact plate, with pull relief being provided for the cable ends, the improvement comprising:

comb-like cable guide elements having recesses, each recess for guiding a corresponding row of cable ends, said comb-like cable guide elements being disposed in a plane spaced in a first direction from the plug-in contact plate and spaced from one another in said plane;

fastening means fixing said guide elements relative to the plug-in contact plate; and resilient clamping devices, respectively adjacent to the recesses, for absorbing a pull on the cable ends.

2. A device as in claim 1, wherein the fastening means are disposed between the plug-in contact plate and the comb-like cable guide elements, said fastening means and said guide elements together forming a frame-like module carrier which is attached to a rear side of the plug-in contact plate, said comb-like cable guide elements forming rear plates of the carrier.

3. A device as in claim 2 wherein the comb-like cable guide elements are vertically extending and successively spaced from one another next to one another, individually or in pairs.

4. A device as in claim 3, further comprising contact strips on the contact plate between the plug-in contacts, wherein free spaces are provided between the individual comb-like cable guide elements for insertion of respective circuit boards in a second direction opposite said first direction toward the contact strips.

5. A device as in claim 4, further comprising guide rails at an upper side and an underside of the fastening means for guiding the insertion of the circuit boards.

6. A device as in claim 4, wherein the circuit boards have handles which project in said first direction beyond the plane of the comb-like cable guide elements.

7. A device as in claim 1, wherein the comb-like cable guide elements are respectively composed of L-shaped profiled members.

8. A device as in claim 7, wherein the L-shaped profiled members have flat ends for mounting to the fastening means.

9. A device as in claim 7, wherein the L-shaped profiled members have first and second arms, said first arms having the recess, the resilient clamping devices being mounted to said second arms, spaced in said second direction and aligned with the respective recesses.

10. A device as in claim 1 wherein the comb-like cable guide elements each have a plate shape.

11. A device as in claim 1, further comprising connecting webs between an underside of the fastening means and an upper side of the fastening means, and the resilient clamping devices are attached to said connecting webs.

12. A device as in claim 1, wherein the resilient clamping devices are each composed of pairs of spring clips which are made of a flat material.

13. A device as in claim 12, wherein the spring clips have sector-shaped bulges for gripping around the cable sheath.

14. A device as in claim 2, wherein successive pairs of the guide elements are horizontally spaced and extend vertically, guide elements of each pair abutting one another.

* * * * *

UNITED STATES PATENT AND TRADEMARK OFFICE

CERTIFICATE OF CORRECTION

PATENT NO. : 4,900,265

DATED : February 13th, 1990

INVENTOR(S) : Michael Gridley, Hans-Ulrich Kalweit

It is certified that error appears in the above-identified patent and that said Letters Patent is hereby corrected as shown below:

In the drawings, Fig. 6 should appear as shown on the attached sheet.

Signed and Sealed this

Nineteenth Day of February, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,900,265

DATED : February 13th, 1990

INVENTOR(S) : Michael Gridley, Hans-Ulrich Kalweit

It is certified that error appears in the above-identified patent and that said Letters Patent is hereby corrected as shown below:

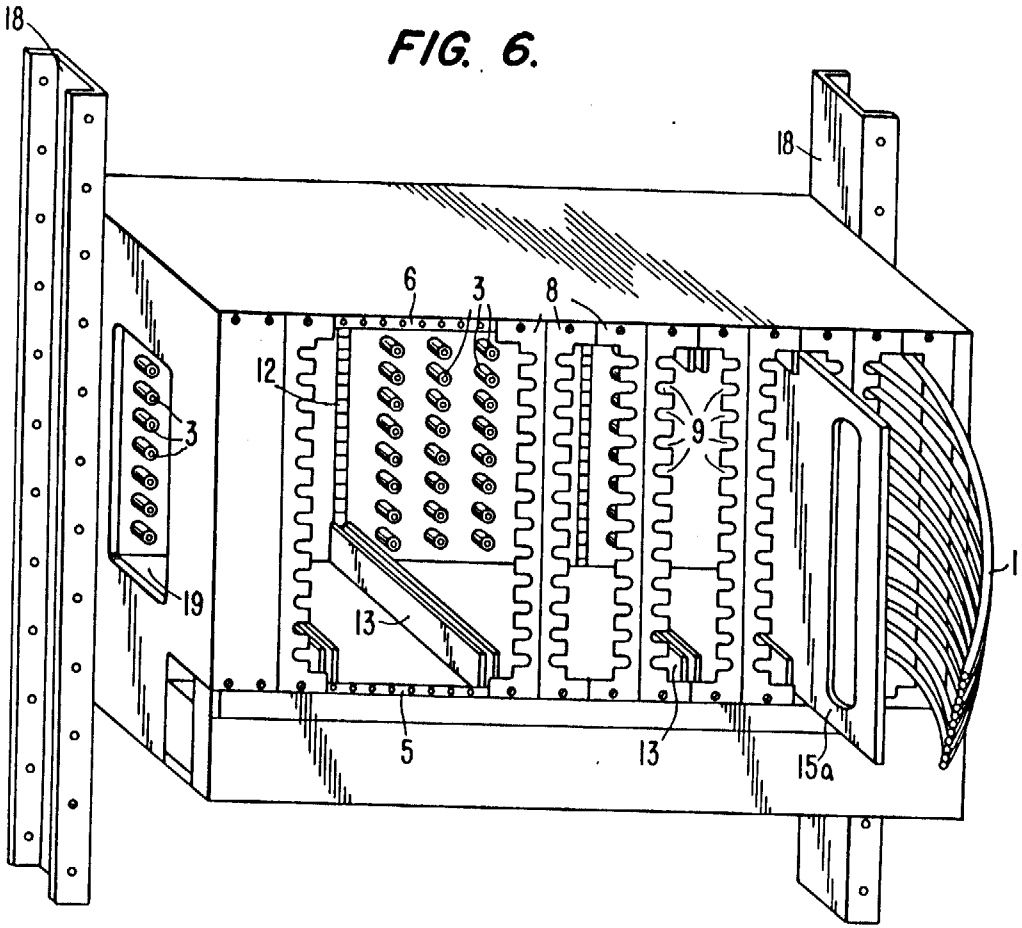

FIG. 6.